US011874066B2

(12) United States Patent
Jiang et al.

(10) Patent No.: US 11,874,066 B2
(45) Date of Patent: Jan. 16, 2024

(54) MICRO-CHANNEL HEAT EXCHANGER

(71) Applicant: ZHEJIANG DUNAN THERMAL TECHNOLOGY CO., LTD., Zhejiang (CN)

(72) Inventors: Jun Jiang, Zhejiang (CN); Feng Wang, Zhejiang (CN); Chenghao Fang, Zhejiang (CN)

(73) Assignee: ZHEJIANG DUNAN THERMAL TECHNOLOGY CO., LTD., Zhuji (CN)

( * ) Notice: Subject to any disclaimer, the term of this patent is extended or adjusted under 35 U.S.C. 154(b) by 0 days.

(21) Appl. No.: 16/459,618

(22) Filed: Jul. 2, 2019

(65) Prior Publication Data

US 2020/0011616 A1 Jan. 9, 2020

(51) Int. Cl.
*F28D 1/047* (2006.01)
*F28F 1/14* (2006.01)

(52) U.S. Cl.
CPC ..... *F28D 1/0476* (2013.01); *F28F 1/14* (2013.01); *F28F 2260/02* (2013.01)

(58) Field of Classification Search
CPC ..... F28D 1/0476; F28F 1/14; F28F 2260/02
See application file for complete search history.

(56) References Cited

U.S. PATENT DOCUMENTS 10,060,687 B2 * 8/2018 Wu ..... F28F 9/26
2003/0183378 A1 * 10/2003 Memory ..... F28F 1/025 165/153
2008/0277095 A1 * 11/2008 Zhai ..... F28F 1/025 165/80.4
2011/0247791 A1 * 10/2011 Jiang ..... F28F 1/32 165/173
2015/0168071 A1 * 6/2015 Gao ..... F28D 1/0476 165/151

(Continued)

FOREIGN PATENT DOCUMENTS

EP 1231448 A2 8/2002
EP 1231448 A3 2/2004
JP 2015078829 A * 4/2015 ..... F28D 1/0476

OTHER PUBLICATIONS

Supplemental EP Search Report dated Oct. 29, 2019 re: Application No. 19184276.4, pp. 1-7, citing: US20030183378A1 and US20150168071A1.

(Continued)

*Primary Examiner* — Henry T Crenshaw
(74) *Attorney, Agent, or Firm* — Gang Yu

(57) ABSTRACT

An embodiment of the disclosure provides a micro-channel heat exchanger, which includes a flat tube, wherein a width of the flat tube is A, a thickness of the flat tube is T; a plurality of flat tubes are provided, the plurality of flat tubes are arranged in parallel along a first direction, a distance between straight sections of two adjacent flat tubes in the plurality of flat tubes 10 is B, and the first direction is parallel to a symmetry plane; and a length direction of a projection of each of the straight sections on the symmetry plane is a height direction, and a distance between a highest point of the outer bent surface and a lowest point of a top end of the inner bent surface along the height direction on the symmetry plane is H1, wherein $H1 \leq [(A/B)+1] \times T$.

6 Claims, 5 Drawing Sheets

(56) References Cited

U.S. PATENT DOCUMENTS

| | | | | |
|---|---|---|---|---|
| 2017/0059252 | A1* | 3/2017 | Zhou | F28F 9/0243 |
| 2017/0082332 | A1* | 3/2017 | Onaka | F25B 39/00 |
| 2017/0211886 | A1* | 7/2017 | Morimura | F28F 9/028 |
| 2018/0010824 | A1* | 1/2018 | Drost | F24S 10/72 |
| 2018/0058763 | A1* | 3/2018 | Wei | F28F 9/0275 |

OTHER PUBLICATIONS

EP Examination Report dated Mar. 2, 2022 re: Application No. 19184276.4, pp. 1-4.

* cited by examiner

MICRO-CHANNEL HEAT EXCHANGER

TECHNICAL FIELD

The disclosure relates to a technical field of heat exchangers, and particularly to a micro-channel heat exchanger.

BACKGROUND

For enhancing the heat exchange effect of a micro-channel heat exchanger, flat tubes in the micro-channel heat exchanger may be arranged into a parallel double-row or multi-row structure, a plurality of flat tubes are arranged in each row. For ensuring uniform distribution of a refrigerant in the flat tubes, a liquid distribution device is usually required to be added to uniformly distribute the refrigerant into each flat tube. This makes the structure of the micro-channel heat exchanger complex.

SUMMARY

An embodiment of the disclosure provides a micro-channel heat exchanger, to solve the problem that the structure of a micro-channel heat exchanger in a related art is complex.

Some embodiments of the present disclosure provides a micro-channel heat exchanger, which includes a flat tube, wherein a width of the flat tube is A, a thickness of the flat tube is T, the flat tube includes a bent section and two straight sections, end portions of the two straight sections are communicated with two ends of the bent section respectively, the bent section has an outer bent surface and an inner bent surface in a thickness direction of the bent section, and the two straight sections are symmetrically arranged relative to a symmetry plane; wherein a plurality of flat tubes are provided, the plurality of flat tubes are arranged in parallel along a first direction, a distance between straight sections of two adjacent flat tubes in the plurality of flat tubes is B, and the first direction is parallel to the symmetry plane; and a length direction of a projection of each of the straight sections on the symmetry plane is, a height direction, and a distance between a highest point of the outer bent surface and a lowest point of a top end of the inner bent surface along the height direction on the symmetry plane is H1, wherein $H1 \leq [(A/B)+1] \times T$.

In an exemplary embodiment, the bent section is formed by bending around an axis, and a distance between the axis and a lowest point of the bent section along the height direction is H2, wherein $A \leq H2 \leq 3A$.

In an exemplary embodiment, the bent section is formed by bending around an axis with a predetermined radius R1, and a distance between the lowest point of the top end of the inner bent surface and the axis in the height direction on the symmetry plane is H3, $R1 \leq H3 \leq 1.2R1$.

In an exemplary embodiment, the bent section is formed by bending around an axis with the predetermined radius R1, and a distance between the highest point of the outer bent surface and the lowest point of the bent section in the height direction is H, $T+R1 \leq H \leq [(A/B)+1] \times T+1.2R1+2A$.

In an exemplary embodiment, the flat tube is of an integrated structure, and length directions of the two straight sections of the flat tube are parallel.

In an exemplary embodiment, the micro-channel heat exchanger further includes a first collector tube, end portions of straight sections, on one side of the symmetry plane, of the plurality of flat tubes being communicated with the first collector tube; and a second collector tube, end portions of straight sections, on the other side of the symmetry plane, of the plurality of flat tubes being communicated with the second collector tube.

In an exemplary embodiment, the bent section is formed by bending around an axis with a predetermined radius R1, both the first collector tube and the second collector tube extend in the first direction, a radius of an outer circumference of the first collector tube is R2, and a radius of an outer circumference of the second collector tube is R3, $$R3 \leq R2 \leq R1 \leq 2R2+A.$$

In an exemplary embodiment, a thickness direction of each of the two straight sections of the flat tube is parallel to the first direction, and along the thickness direction of the each of the two straight sections 11, the bent section of the flat tube is arranged in a manner of protruding towards one side of the each of the two straight sections.

In an exemplary embodiment, every two adjacent bent sections of the plurality of flat tubes are arranged in an inserting manner, and the inner bent surface of one bent section in the two adjacent bent sections is abutted against with the outer bent surface of the other bent section in the two adjacent bent sections.

In an exemplary embodiment, the micro-channel heat exchanger further includes a fin, the fin being arranged between the straight sections of the two adjacent flat tubes in the plurality of flat tubes.

With adoption of the technical solution of the disclosure, a bent section and two straight sections are arranged in each flat tube, the plurality of flat tubes are arranged in parallel, and in such a manner, a double-row structure is formed by the straight sections of the flat tubes, so that a heat exchange effect is improved. In addition, the two straight sections of each flat tube are communicated through the bent section of a corresponding flat tube, and uniformity of a refrigerant is ensured without arranging a liquid distribution device to redistribute the refrigerant, so that arrangement of the bent sections can simplify the structure of the micro-channel heat exchanger. Moreover, a dimension relationship of the width A of the flat tube, the thickness T of the flat tube, the distance B between the straight sections of two adjacent flat tubes and the distance H1 between the highest point of the outer bent surface and the lowest point of the top end of the inner bent surface of the bent section on the symmetry plane is restricted as $H1 \leq [(A/B)+1] \times T$, so that machining of the bent sections of the flat tubes and assembling of the plurality of flat tubes can be facilitated, and manufacturing cost is reduced. Furthermore, the dimension relationship is favorable for bending the flat tubes with slight deformation at bends and without influence on performance and burst pressure of a product, and the product is regular in size and relatively attractive in appearance.

BRIEF DESCRIPTION OF THE DRAWINGS

The drawings forming a part of the application in the specification are adopted to provide a further understanding to the disclosure. Schematic embodiments of the disclosure and descriptions thereof are adopted to explain the disclosure and not intended to form improper limits to the disclosure. In the drawings.

Figure 1:
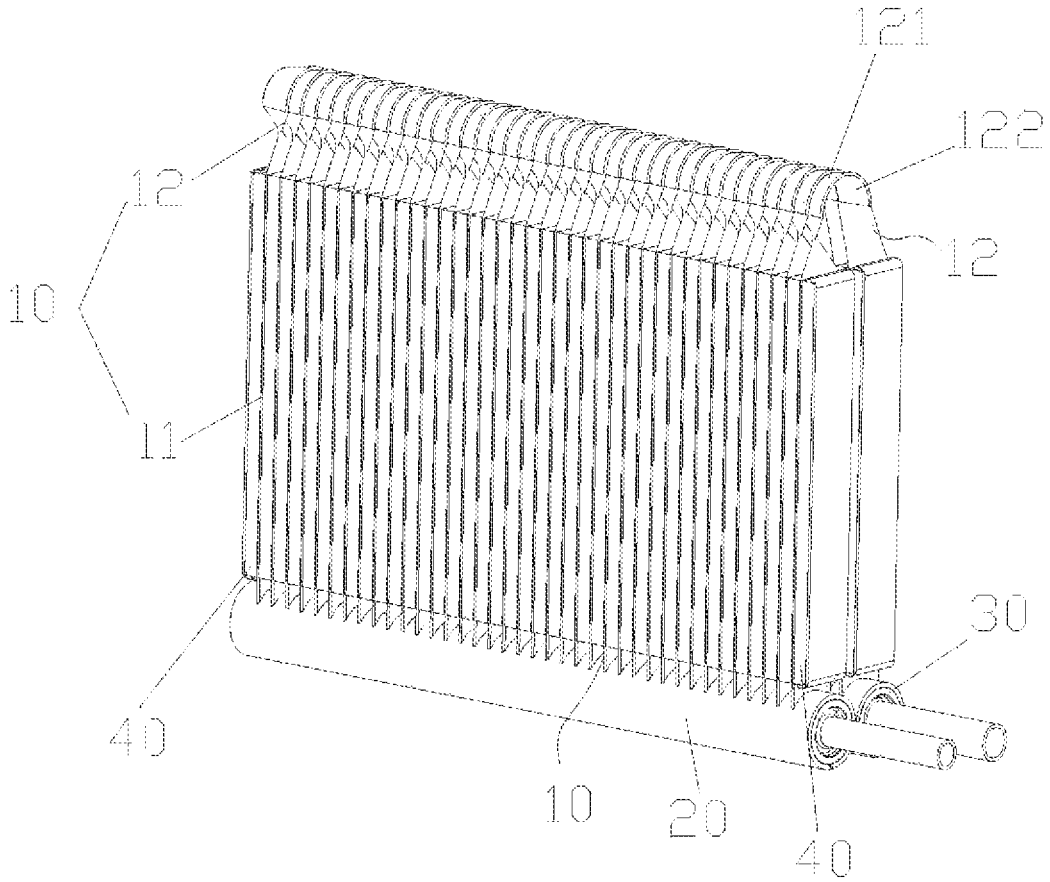
FIG. 1 illustrates a structure diagram of a micro-channel heat exchanger according to an embodiment of the disclosure.

Herein, the drawings include the following reference drawing markers:

10, flat tube; 11, straight section; 12, bent section; 121, outer bent surface; 122, inner bent surface; 20, first collector tube; 30, second collector tube; 40, fin; C, symmetry plane; D, first direction; and E, height direction; F, a highest point of the outer bent surface; G, a lowest point of a top end of the inner bent surface.

DETAILED DESCRIPTION OF THE EMBODIMENTS

The technical solutions in the embodiments of the disclosure will be clearly and completely described below in combination with the drawings in the embodiments of the disclosure. It is apparent that the described embodiments are not all of the embodiments but only part of the embodiments of the disclosure. The following description of at least one exemplary embodiment is only illustrative actually, and is not used as any limitation for the disclosure and the application or use thereof. All other embodiments obtained by those of ordinary skill in the art on the basis of the embodiments in the disclosure without creative work shall fall within the scope of protection of the disclosure.

As shown in FIG. 1 to FIG. 6, an embodiment of the disclosure provides a micro-channel heat exchanger, which includes a flat tube 10, wherein a width of the flat tube 10 is A, a thickness of the flat tube 10 is T, the flat tube 10 includes a bent section 12 and two straight sections 11, end portions of the two straight sections 11 are communicated with two ends of the bent section 12 respectively, the bent section 12 has an outer bent surface 121 and an inner bent surface 122 along a thickness direction of the bent section 12, and the two straight sections 11 are symmetrically arranged relative to a symmetry plane C; wherein a plurality of flat tubes 10 are provided, the plurality of flat tubes 10 are arranged in parallel along a first direction, a distance between straight sections 11 of two adjacent flat tubes 10 in the plurality of flat tubes 10 is B, and the first direction D is parallel to the symmetry plane C; and a length direction of a projection of each of the straight sections 11 on the symmetry plane C is a height direction E, and a distance between a highest point of the outer bent surface F and a lowest point of a top end of the inner bent surface G along the height direction Eon the symmetry plane C is H1, wherein $H1 \leq [(A/B)+1] \times T$.

The two adjacent flat tubes 10 includes a first flat tube and a second flat tube, two straight sections 11 of the first flat tube 10 are opposite to two straight sections 11 of the second flat tube 10 in a one-by-one corresponding manner. A distance between each of the two straight sections 11 of the first flat tube 10 and a corresponding straight section 11 of a second flat tube 10 is B.

With adoption of the technical solution of the embodiment, a bent section 12 and two straight sections 11 are arranged in each flat tube 10, the plurality of flat tubes 10 are arranged in parallel, and in such a manner, a double-row structure is formed by the straight sections of the flat tubes 10, so that a heat exchange effect is improved. In addition, the two straight sections 11 of each flat tube 10 are communicated through the bent section 12 of a corresponding flat tube 10, and uniformity of a refrigerant is ensured without arranging a liquid distribution device to redistribute the refrigerant, so that arrangement of the bent sections 12 can simplify the structure of the micro-channel heat exchanger. Moreover, a dimension relationship of the width A of the flat tube 10, the thickness T of the flat tube 10, the distance B between the straight sections 11 of two adjacent flat tubes 10 and the distance H1 between the highest point of the outer bent surface 121 and the lowest point of the top end of the inner bent surface 122 of the bent section in the height direction E on the symmetry plane C is restricted as $H1 \leq [(A/B)+1] \times T$, so that machining of the bent sections 12 of the flat tubes 10 and assembling of the plurality of flat tubes 10 can be facilitated, and manufacturing cost is reduced. Furthermore, the dimension relationship is favorable for bending the flat tubes 10 with slight deformation at bends and without influence on performance and burst pressure of a product, and the product is regular in size and relatively attractive in appearance.

Figure 3:
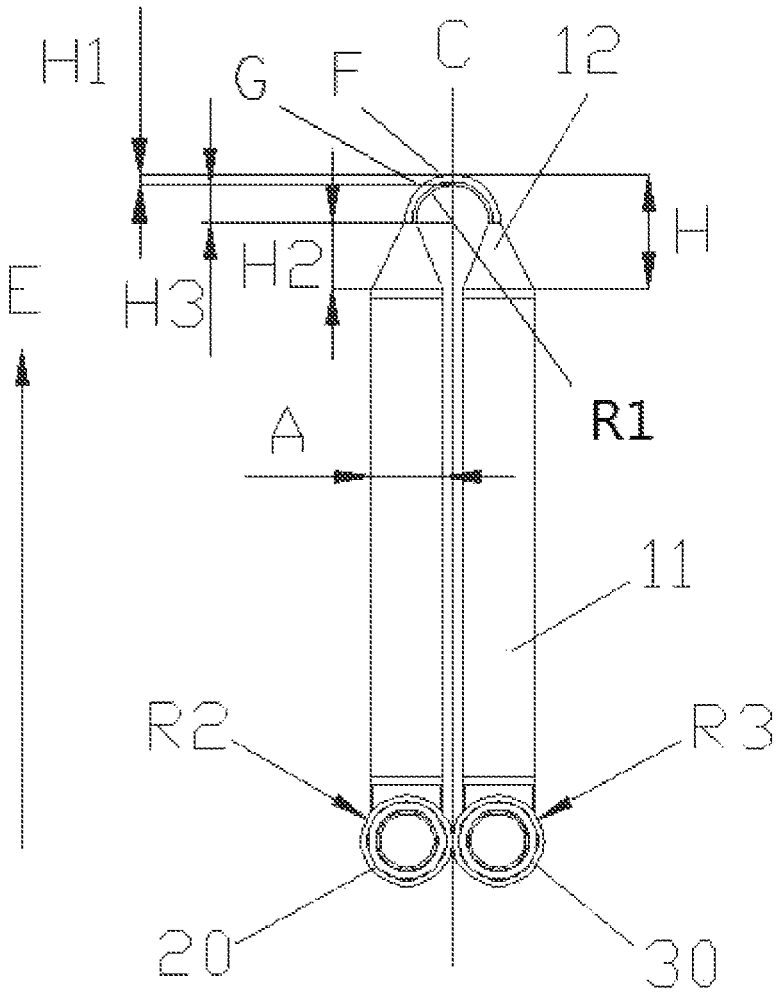
FIG. 3 illustrates a right side view of the micro-channel heat exchanger in FIG. 2.

As shown in FIG. 3, in the embodiment, the bent section 12 is formed by bending around an axis, and a distance between the axis and a lowest point of the bent section 12 alone the height direction E is H2, wherein $A \leq H2 \leq 3A$. The axis is a reference line provided in advance for machining. Restricting H2 to this magnitude may ensure that the bent section 12 is formed smoothly without fractures or cracks and may also avoid a large space being occupied by the bent section 12 in an excessively large size.

In an exemplary embodiment, the bent section 12 is formed by bending around an axis with a predetermined radius R1, and a distance between the lowest point of the top end of the inner bent surface 122 and the axis in the height direction E on the symmetry plane C is H3, $R1 \leq H3 \leq 1.2R1$. The bent section 12 is bent with a certain elastic deformation, so that a value of H3 after bending is greater than R1, and restricting the value of H3 within such a magnitude range may reserve elastic deformation and may also ensure dimensional accuracy of the bent section 12, so as to facilitate machining as well as assembling of the plurality of flat tubes 10.

In the embodiment, the bent section 12 is formed by bending around the axis with the predetermined radius R1, and a distance between the highest point of the outer bent surface 12 and the lowest point of the bent section 12 in the height direction E is H, $T+R1 \leq H \leq [(A/B)+1] \times T+1.2R1+2A$. Therefore, an overall height dimension of the bent section 12 is restricted to ensure a dimensional accuracy of the bent section 12, so as to facilitate bending forming and assembling of the micro-channel heat exchanger. In the embodiment, a sum of H1, H2 and H3 is a value of H.

In the embodiment, the flat tube 10 is of an integrated structure, and length directions of the two straight sections 11 of the flat tube 10 are parallel. The flat tube 10 is arranged into the integrated structure, so that the flat tube 10 is conveniently manufactured. During machining, the flat tube 10 is machined into a straight structure at first and then bent to obtain the bent section 12 and the straight sections 11. The length directions of the two straight sections 11 of the flat tube 10 are arranged to be parallel, so that the micro-channel heat exchanger is more compact, and an occupied space is reduced.

Figure 2:
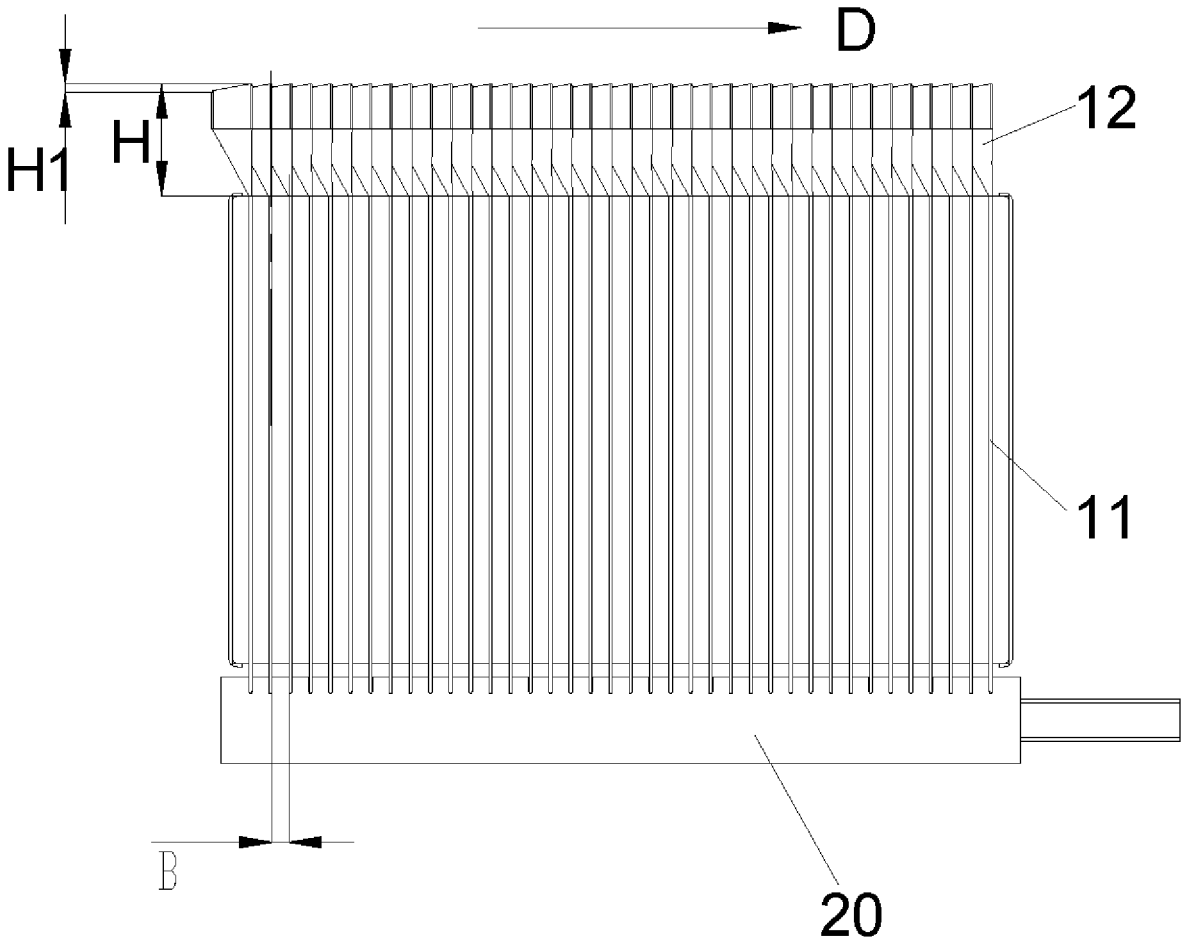
FIG. 2 illustrates a plane view of the micro-channel heat exchanger in FIG. 1.

As shown in FIG. 1 to FIG. 3, the heat exchanger further includes a first collector tube 20, end portions of straight sections 11, on one side of the symmetry plane C, of the plurality of flat tubes 10 being communicated with the first collector tube 20; and a second collector tube 30, end portions of straight sections 11, on the other side of the symmetry plane C, of the plurality of flat tubes 10 being communicated with the second collector tube 30.

In the embodiment, the bent section 12 is formed by bending around the axis with the predetermined radius R1, both the first collector tube 20 and the second collector tube 30 extend in the first direction D, a radius of an outer circumference of the first collector tube 20 is R2, and a radius of an outer circumference of the second collector tube 30 is R3, $R3 \leq R2 \leq R1 \leq 2R2+A$. Restricting sizes of the first collector tube 20 and the second collector tube 30 within such a range can facilitate assembling of the micro-channel heat exchanger and make the structure of the micro-channel heat exchanger compact. In the embodiment, positions of the first collector tube 20 and the second collector tube 30 can be interchanged as long as the dimension relationship is satisfied.

Figure 4:
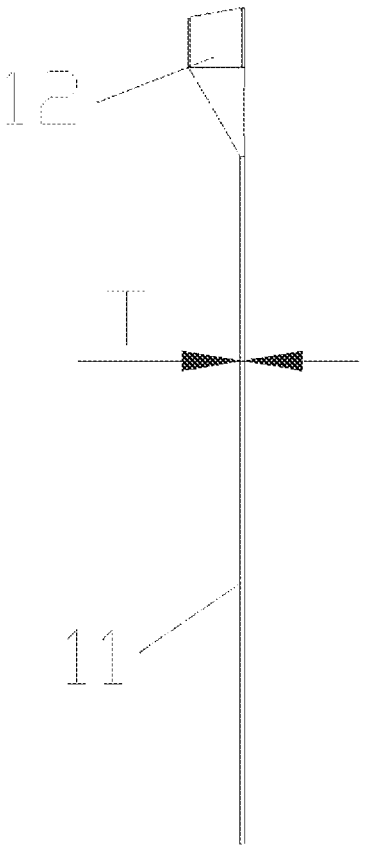
FIG. 4 illustrates a structure diagram of a flat tube of the micro-channel heat exchanger in FIG. 1.
Figure 5:
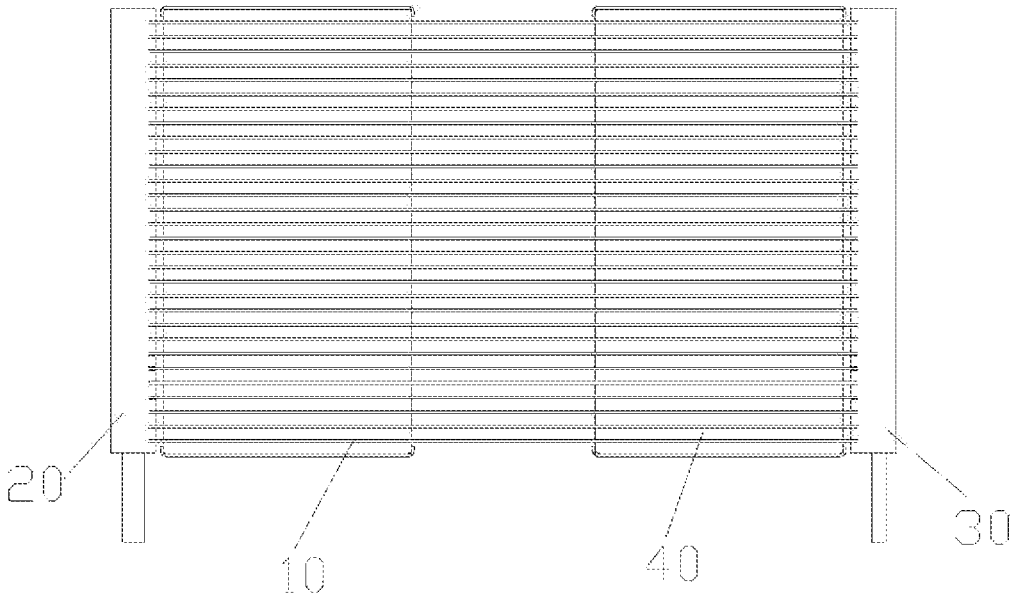
FIG. 5 illustrates a structure diagram of the micro-channel heat exchanger in FIG. 1 before bending.
Figure 6:
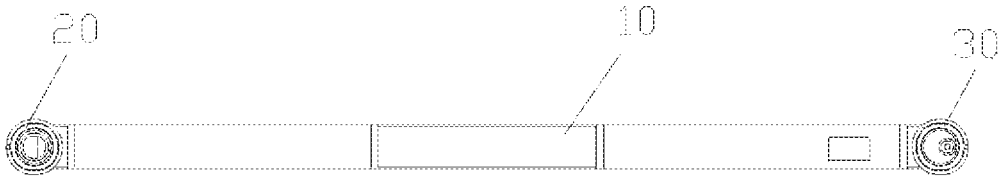
FIG. 6 illustrates a bottom view of FIG. 5.

As shown in FIG. 2 and FIG. 4, a thickness direction of each of the two straight sections 11 of the flat tube 10 is parallel to the first direction D, and along the thickness direction of the each of the two straight sections 11, the bent section 12 of the flat tube 10 is arranged in a manner of protruding towards one side of the each of the two straight sections 11. Therefore, the plurality of flat tubes 10 can be conveniently assembled, and the structure of the micro-channel heat exchanger is more compact. Moreover, in combination with restriction of the dimension relationship, less air may leak in regions of the bent sections 12 of the plurality of flat tubes 10 (because there are no fins in the regions of the bent sections 12, heat exchange is avoided in the regions of the bent sections 12).

In the embodiment, every two adjacent bent sections 12 of the plurality of flat tubes 10 are arranged in a inserting manner, and the inner bent surface 122 of one bent section 12 in the two adjacent bent sections 12 is abutted against the outer bent surface 121 of the other bent section 12 in the two adjacent bent sections 12. In such an arrangement manner, the magnitude of the distance B between the straight sections 11 of two adjacent flat tubes 10 is reduced, and the structure of the micro-channel heat exchanger is compact, so that enlargement of the overall dimension of the micro-channel heat exchanger by a existence of the bent sections 12 is avoided.

In the embodiment, the micro-channel heat exchanger further includes a fin 40, the fin 40 is arranged between the straight sections 11 of the two adjacent flat tubes 10 in the plurality of flat tubes 10. Arrangement of the fins 40 enlarge a heat exchange area of the micro-channel heat exchanger and facilitate heat exchange between the micro-channel heat exchanger and an external environment or component, so that a heat exchange capability of the micro-channel heat exchanger is improved.

With adoption of the technical solution of the embodiment, a bent section 12 and two straight sections 11 are arranged in each flat tube 10, the plurality of flat tubes 10 are arranged in parallel, and in such a manner, a double-row structure is formed by the straight sections of the flat tubes 10, so that a heat exchange effect is improved.

In addition, the two straight sections 11 of each flat tube 10 are communicated through the bent section 12 of the corresponding flat tube 10, and uniformity of a refrigerant is ensured without arranging a liquid distribution device to redistribute the refrigerant, so that arrangement of the bent sections 12 may simplify the structure of the micro-channel heat exchanger.

Moreover, the dimension relationship of the width A of the flat tube 10, the thickness T of the flat tube 10, the distance B between the straight sections 11 of two adjacent flat tubes 10 and the distance H1 between the highest point of the outer bent surface 121 and the lowest point of the top end of the inner bent surface 122 of the bent section 12 in the height direction E on the symmetry plane C is restricted as $H1 \leq [(A/B)+1] \times T$, the magnitude of the distance H2 between the axis and the lowest point of the bent section 12 is restricted as $A \leq H2 \leq 3A$, the magnitude of the distance H3 between the lowest point of the top end of the inner bent surface 122 and the axis is restricted as $R1 \leq H3 \leq 1.2R1$, and the dimensions of the first collector tube 20 and the second collector tube 30 are restricted, so that machining of the bent sections 12 of the flat tubes 10 and assembling of the plurality of flat tubes 10 can be facilitated, and manufacturing cost is reduced. Furthermore, the dimension relationship is favorable for bending the flat tubes 10 with slight deformation at bends and without influence on performance and burst pressure of a product, and the product is regular in size and relatively attractive in appearance. Every two adjacent bent sections 12 of the plurality of bent sections 10 are provided in a inserting manner, and the inner bent surface 122 of one bent section 12 of the two adjacent bent sections 12 is connected against with the outer bent surface 121 of the other bent section 12 of the two adjacent bent sections 12, so that the magnitude of the distance B between the straight sections 11 of two adjacent flat tubes 10 may be reduced, the structure of the micro-channel heat exchanger is compact, and less air leaks in the regions of the bent sections 12.

The above is only the preferred embodiment of the disclosure and not intended to limit the disclosure. For those skilled in the art, the disclosure may have various modifications and variations. Any modifications, equivalent replacements, improvements and the like made within the spirit and principle of the disclosure shall fall within the scope of protection of the disclosure.

It is to be noted that terms used herein only aim to describe specific implementation manners, and are not intended to limit exemplar implementations of this application. Unless otherwise directed by the context, singular forms of terms used herein are intended to include plural forms. Besides, it will be also appreciated that when terms "contain" and/or "include" are used in the description, it is indicated that features, steps, operations, devices, assemblies and/or a combination thereof exist.

Unless otherwise specified, relative arrangements of components and steps elaborated in these embodiments, numeric expressions and numeric values do not limit the scope of the disclosure. Furthermore, it should be understood that for ease of descriptions, the size of each part shown in the drawings is not drawn in accordance with an actual proportional relation. Technologies, methods and devices known by those skilled in the related art may not be discussed in detail. However, where appropriate, the technologies, the methods and the devices shall be regarded as part of the authorized description. In all examples shown and discussed herein, any specific values shall be interpreted as only exemplar values instead of limited values. As a result, other examples of the exemplar embodiments may have different values. It is to be noted that similar marks and letters represent similar items in the following drawings. As a result, once a certain item is defined in one drawing, it is unnecessary to further discus the certain item in the subsequent drawings.

In the descriptions of the disclosure, it will be appreciated that locative or positional relations indicated by "front, back, up, down, left, and right", "horizontal, vertical, perpendicular, and horizontal", "top and bottom" and other terms are locative or positional relations shown on the basis of the drawings, which are only intended to make it convenient to describe the disclosure and to simplify the descriptions without indicating or impliedly indicating that the referring device or element must have a specific location and must be constructed and operated with the specific location, and accordingly it cannot be understood as limitations to the disclosure. The nouns of locality "inner and outer" refer to the inner and outer contours of each component.

For ease of description, spatial relative terms such as "over", "above", "on an upper surface" and "upper" may be used herein for describing a spatial position relation between a device or feature and other devices or features shown in the drawings. It will be appreciated that the spatial relative terms aim to contain different orientations in usage or operation besides the orientations of the devices described in the drawings. For example, if the devices in the drawings are inverted, devices described as "above other devices or structures" or "over other devices or structures" will be located as "below other devices or structures" or "under other devices or structures". Thus, an exemplar term "above" may include two orientations namely "above" and "below". The device may be located in other different modes (rotated by 90 degrees or located in other orientations), and spatial relative descriptions used herein are correspondingly explained.

In addition, it is to be noted that terms "first", "second" and the like are used to limit parts, and are only intended to distinguish corresponding parts. If there are no otherwise statements, the above terms do not have special meanings, such that they cannot be understood as limits to the scope of protection of the disclosure.

What is claimed is:

1. A micro-channel heat exchanger, comprising:

a plurality of flat tubes, wherein a width of each flat tube of the plurality of flat tubes is A, a thickness of each flat tube of the plurality of flat tubes is T, each of the plurality of flat tubes comprises a bent section and two straight sections, end portions of the two straight sections are communicated with two ends of the bent section respectively, the bent section has an outer bent surface and an inner bent surface along a thickness direction of the bent section, and the two straight sections are symmetrically arranged relative to a symmetry plane;

wherein the plurality of flat tubes are arranged in parallel along a first direction, a distance between straight sections of two adjacent flat tubes in the plurality of flat tubes is B, and the first direction is parallel to the symmetry plane; and a length direction of a projection of each of the straight sections on the symmetry plane is a height direction, and a distance between a highest point of the outer bent surface and a lowest point of a top end of the inner bent surface along the height direction on the symmetry plane is H1, every two adjacent bent sections of the plurality of flat tubes are arranged in an inserting manner; characterizing in that:

wherein $H1 \leq [(A/B)+1] \times T$;

a distance between the highest point of the top end of the inner bent surface and an axis in the height direction on the symmetry plane is H3, $R1 < H3 \leq 1.2R1$; wherein R1 is a radius from the axis to the inner bent surface, and the bent section is bent with an elastic deformation;

a distance between the highest point of the outer bent surface and the lowest point of the bent section in the height direction is H, $T+R1 \leq H \leq [(A/B)+1] \times T+1.2R1+2A$;

further comprising:

a first collector tube, having end portions of one of the two straight sections on one side of the symmetry plane of the plurality of flat tubes being communicated with the first collector tube; and a second collector tube, having end portions of the other of the two straight sections on the other side of the symmetry plane of the plurality of flat tubes being communicated with the second collector tube;

wherein both the first collector tube and the second collector tube extend in the first direction, a radius of an outer circumference of the first collector tube is R2, and a radius of an outer circumference of the second collector tube is R3, wherein, $R3 \leq R2 \leq R1 \leq 2R2+A$.

2. The micro-channel heat exchanger as claimed in claim 1, wherein a distance between the axis and a lowest point of the bent section along the height direction is H2, wherein $A \leq H2 \leq 3A$.

3. The micro-channel heat exchanger as claimed in claim 1, wherein the flat tube is of an integrated structure, and length directions of the two straight sections of the flat tube are parallel.

4. The micro-channel heat exchanger as claimed in claim 1, wherein a thickness direction of each of the two straight sections of the flat tube is parallel to the first direction, and along the thickness direction of the each of the two straight sections, the bent section of the flat tube is arranged in a manner of protruding towards one side of the each of the two straight sections.

5. The micro-channel heat exchanger as claimed in claim 1, wherein the inner bent surface of one bent section in the two adjacent bent sections is partially abutted against the outer bent surface of the other bent section in the two adjacent bent sections.

6. The micro-channel heat exchanger as claimed in claim 1, further comprising:

a fin, the fin being arranged between the straight sections of the two adjacent flat tubes in the plurality of flat tubes.

* * * * *